US009112271B2

(12) United States Patent
Mo et al.

(10) Patent No.: US 9,112,271 B2
(45) Date of Patent: Aug. 18, 2015

(54) TERMINAL DEVICE

(71) Applicants: LENOVO (BEIJING) CO., LTD., Beijing (CN); BEIJING LENOVO SOFTWARE LTD., Haidian District, Beijing (CN)

(72) Inventors: Dafei Mo, Beijing (CN); Kangkang Chen, Beijing (CN); Zhaowei Hu, Beijing (CN); Xiongbing Gong, Beijing (CN); Lu Lu, Beijing (CN)

(73) Assignees: LENOVO (BEIJING) CO., LTD., Beijing (CN); BEIJING LENOVO SOFTWARE LTD., Beijing (CN)

( * ) Notice: Subject to any disclaimer, the term of this patent is extended or adjusted under 35 U.S.C. 154(b) by 255 days.

(21) Appl. No.: 13/647,602

(22) Filed: Oct. 9, 2012

(65) Prior Publication Data

US 2013/0088397 A1 Apr. 11, 2013

(30) Foreign Application Priority Data

Oct. 9, 2011 (CN) ..... 2011 1 0303440
Oct. 24, 2011 (CN) ..... 2011 1 0326512

(51) Int. Cl.
*H01Q 1/24* (2006.01)
*H01Q 1/36* (2006.01)
*H01Q 1/44* (2006.01)

(52) U.S. Cl.
CPC ..... *H01Q 1/36* (2013.01); *H01Q 1/243* (2013.01); *H01Q 1/44* (2013.01)

(58) Field of Classification Search
CPC ..... H01Q 1/24; H01Q 1/241; H01Q 1/242; H01Q 1/243; H01Q 1/36; H01Q 1/44
USPC ..... 343/702
See application file for complete search history.

(56) References Cited

U.S. PATENT DOCUMENTS 6,686,888 B1 2/2004 Wendt et al.
6,891,726 B1 5/2005 Montoya (Continued)

FOREIGN PATENT DOCUMENTS

CN 2003202889 2/2003
CN 2634665 8/2004

(Continued)

OTHER PUBLICATIONS

First Examination Report dated Jul. 12, 2013 from corresponding German Application No. 10 2012 109 565.5 (12 pages including English translation).

(Continued)

*Primary Examiner* — Hoang V Nguyen
(74) *Attorney, Agent, or Firm* — Brinks Gilson & Lione; G. Peter Nichols

(57) ABSTRACT

A terminal device includes a first house configured to at least accommodate a processing unit and a wireless communication unit. The wireless communication unit is configured to cause the terminal device to perform wireless communication with an external apparatus and exchange data. The wireless communication unit includes an antenna unit configured to receive and transmit a RF signal, a RF circuit connected with the antenna unit and configured to transmit the RF signal to or receive the RF signal from the antenna unit, wherein, an air vent is set on the first house, and the antenna unit is formed by the air vent.

15 Claims, 4 Drawing Sheets

(56) References Cited

U.S. PATENT DOCUMENTS

| | | | | |
|---|---|---|---|---|
| 7,612,725 | B2 | 11/2009 | Hill et al. | |
| 7,843,396 | B2 | 11/2010 | Hill et al. | |
| 7,924,231 | B2 | 4/2011 | Hill et al. | |
| 7,956,814 | B2 | 6/2011 | Reinheimer et al. | |
| 8,106,836 | B2 | 1/2012 | Hill et al. | |
| 8,169,374 | B2 | 5/2012 | Hill et al. | |
| 8,228,239 | B2 * | 7/2012 | Lagnado et al. | 343/702 |
| 8,253,634 | B2 | 8/2012 | Ohguchi et al. | |
| 8,270,914 | B2 | 9/2012 | Pascolini et al. | |
| 8,410,986 | B2 | 4/2013 | Hill et al. | |
| 8,610,629 | B2 | 12/2013 | Pascolini et al. | |
| 8,907,852 | B2 | 12/2014 | Hill et al. | |
| 2002/0175868 | A1 | 11/2002 | Reichert | |
| 2004/0150571 | A1 | 8/2004 | Deng | |
| 2004/0257283 | A1 | 12/2004 | Asano et al. | |
| 2007/0075075 | A1 | 4/2007 | Jaeger et al. | |
| 2007/0176831 | A1 | 8/2007 | Lagnado et al. | |
| 2008/0316115 | A1 | 12/2008 | Hill et al. | |
| 2009/0066588 | A1 | 3/2009 | Cheng et al. | |
| 2009/0073077 | A1 | 3/2009 | Reinheimer et al. | |
| 2009/0256759 | A1 | 10/2009 | Hill et al. | |
| 2010/0007564 | A1 | 1/2010 | Hill et al. | |
| 2010/0073241 | A1 | 3/2010 | Vazquez et al. | |
| 2010/0182205 | A1 | 7/2010 | Chiang | |
| 2010/0214738 | A1 | 8/2010 | Wang | |
| 2010/0271271 | A1 | 10/2010 | Wu | |
| 2010/0321253 | A1 | 12/2010 | Vazquez et al. | |
| 2010/0328166 | A1 | 12/2010 | Ohguchi et al. | |
| 2011/0006953 | A1 | 1/2011 | Chiang et al. | |
| 2011/0050513 | A1 | 3/2011 | Hill et al. | |
| 2011/0136447 | A1 | 6/2011 | Pascolini et al. | |
| 2011/0183721 | A1 | 7/2011 | Hill et al. | |
| 2011/0291896 | A1 | 12/2011 | Pascolini et al. | |
| 2012/0046002 | A1 | 2/2012 | Hill et al. | |
| 2012/0098720 | A1 | 4/2012 | Hill et al. | |
| 2013/0009828 | A1 | 1/2013 | Pascolini et al. | |
| 2013/0222195 | A1 | 8/2013 | Hill et al. | |
| 2014/0049432 | A1 | 2/2014 | Hill et al. | |

FOREIGN PATENT DOCUMENTS

| | | |
|---|---|---|
| CN | 1642399 | 7/2005 |
| CN | 101355192 | 1/2009 |
| CN | 101682119 | 3/2010 |
| CN | 201533015 U | 7/2010 |
| CN | 101809878 | 8/2010 |
| CN | 101814649 | 8/2010 |
| CN | 102110873 | 6/2011 |
| CN | 102142855 | 8/2011 |
| DE | 199 62 736 | 7/2001 |
| DE | 101 13 285 | 10/2002 |
| DE | 20 2004 021 054 U1 | 5/2007 |
| DE | 10 2006 025 214 | 11/2007 |
| DE | 10 2008 041 583 | 7/2009 |
| EP | 1 176 667 | 1/2002 |
| JP | 4657698 | 3/2011 |

OTHER PUBLICATIONS

Second Examination Report dated Nov. 22, 2013 from corresponding German Application No. 10 2012 109 565.5 (10 pages including English translation).

First Search Report dated Dec. 2, 2014 from corresponding Chinese application 201110303440.0 (11 pages including English translation).

First Search Report dated May 9, 2014 from corresponding Chinese application 201110326512.3 (17 pages including English translation).

Second Search report dated Oct. 27, 2014 from corresponding Chinese application 201110326512.3 (8 pages including English translation).

* cited by examiner

TERMINAL DEVICE

This application claims priority to CN 201110303440.0 filed on Oct. 9, 2011 and also to CN 201110326512.3 filed on Oct. 24, 2011, the entire contents of which is incorporated herein by reference.

BACKGROUND

The present invention relates to the field of terminal device, and specially, relates to a terminal device having a particular antenna structure.

Currently, a terminal device such as a notebook computer uses a metallic house or a plastic house to accommodate hardware such as display, main board and processor. Further, the terminal device usually comprises an antenna for WIFI communication or 3G communication. Here, the antenna usually needs a certain electro-magnetic headroom area (there is no metallic material nearby) to obtain higher signal receiving/transmitting quality. In the design that the terminal device uses the metallic house and provides the antenna in the metallic house, an electro-magnetic shield characteristic of the metallic house usually influences the signal receiving/transmitting quality of the antenna, thus the electro-magnetic headroom area needs to be set on the metallic house (e.g., by a integrated shaping using the plastic and the metal). Further, in the design that the terminal device uses the plastic house and provides the antenna in the plastic house, a relative positional relationship between the antenna and the metallic material of other hardware needs to be considered to ensure an adequate electro-magnetic headroom area. In either means, the design complexity and the cost of the terminal device are usually increased.

SUMMARY

In order to solve the above technical problem in the prior art, according to one aspect of the present invention, there provides a terminal device, comprising: a first house configured to at least accommodate a processing unit and a wireless communication unit; the wireless communication unit configured to cause the terminal device to perform wireless communication with an external apparatus and exchange data, the wireless communication unit further comprising: an antenna unit configured to receive and transmit a RF signal; a RF circuit connected with the antenna unit and configured to transmit the RF signal to or receive the RF signal from the antenna unit, wherein, an air vent is set on the first house, and the antenna unit is formed by the air vent.

Further, according to one embodiment of the present invention, wherein, the air vent is an air inlet of the first house.

Further, according to one embodiment of the present invention, wherein, the air vent is a thermo vent of the first house.

Further, according to one embodiment of the present invention, wherein, the thermo vent is made of metallic material, and metallic bars with a predetermined interval are set between two long sides of the thermo vent, and a gap antenna is formed on the two long sides of the thermo vent and the metallic bars with the predetermined interval as the antenna unit.

Further, according to one embodiment of the present invention, wherein, the thermo vent is made of non-metallic material, and gap antennas with a predetermined interval are formed between the two long sides of the thermo vent as the antenna unit.

Further, according to one embodiment of the present invention, wherein, a RF signal reflecting unit is set in the first house, the RF signal reflecting unit is opposite the antenna unit and has a predetermined interval, and it is configured to reflect the signal transmitted by the antenna unit.

Further, according to one embodiment of the present invention, wherein, the RF signal reflecting unit is a heat sink.

Further, according to one embodiment of the present invention, wherein, the RF signal reflecting unit is a part of a metallic surface of the hard disc.

Further, according to one embodiment of the present invention, wherein, the RF signal reflecting unit is a metallic cavity, and an opening part of the metallic cavity is opposite the antenna unit.

With the above configuration, an inherent part of the terminal device such as the air inlet and the thermo vent is used as the antenna unit or the antenna unit is set on the inherent part. In this case, since it is not needed to provide an adequate headroom area in the terminal device, the influence of the antenna unit is not considered and the position of the respective hardware can be arranged flexibly, thus the design of the terminal device can be simpler. Also, since it is not needed to provide an adequate headroom area in the terminal device, the terminal device can be more compact.

DETAILED DESCRIPTION

Figure 1:
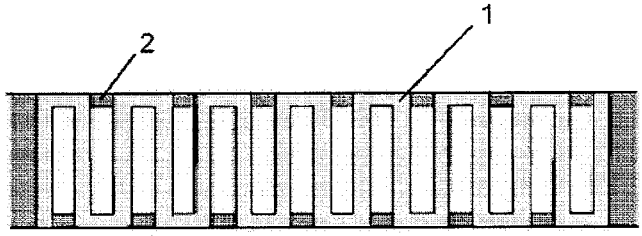
FIG. 1 is a schematic diagram illustrating the structure of the antenna of an embodiment of the present invention.

The respective embodiments of the present invention will be described in detail with reference to the drawings. Here, it is noted that in the drawings, the same reference sign is given to the composition part with substantially the same or similar structure and function, and the repeated description thereof will be omitted.

The terminal device according to the embodiment of the present invention can be a notebook computer of arbitrary type. In this case, the terminal device according to the embodiment of the present invention usually comprises two parts, a display part and a host part, and wherein each part comprises a house to accommodate the corresponding components. For example, for the host part, the terminal device can comprise a house at least accommodating hardware such as a processing unit (e.g., CPU), a main board and a wireless communication unit (e.g., 3G, WIFI or other wireless communication networks) (hereinafter refereed to as the first house). Here, according to the embodiment of the present invention, the first house of the host part can be implemented by metallic or plastic material. Here, for the need of heat release of the hardware, an air vent such as an air inlet or a thermo vent is needed to be set on a predetermined area of the first house. For example, a fan is set inside the terminal device to disperse the heat generated in the hardware via the thermo vent, and fresh air can enter from the air inlet to decrease the temperature of the host part of the terminal device.

The wireless communication unit is for causing the terminal device to perform wireless communication with an external apparatus and exchange data, and it is implemented by an arbitrary type of wireless communication unit (e.g., the one supporting 3G, WIFI or other wireless communication networks). Here, the wireless communication unit may comprise an antenna for receiving and transmitting a RF signal, a RF circuit connected with the antenna and for transmitting the RF signal to or receiving the RF signal from the antenna and the like. Here, it is noted that since the embodiment of the present invention does not relate to the modification of the RF circuit, the relevant description of the RF circuit is omitted here.

According to the embodiment of the present invention, the antenna is formed by the air vent set on the first house.

The structure of the antenna according to the embodiment of the present invention will be described with reference to FIG. 1 hereafter. FIG. 1 is a schematic diagram illustrating the structure of the antenna of an embodiment of the present invention.

Hereafter, the description is made by taking the antenna structure implemented through the thermo vent made of metallic material as an example. As shown in FIG. 1, the thermo vent comprises antenna components 1 and interval portions 2. Here, the thermo vent has two long sides, and a plurality of metallic bars is arranged in parallel between the two long sides with a predetermined interval to form the thermo vent with a barrier shaped structure. Since the thermo vent has a plurality of metallic bars arranged in parallel with a predetermined interval and two long sides, it allows the air to pass through the thermo vent. Further, since the thermo vent is made of metallic material, its heat release performance is excellent.

Here, the thermo vent with the barrier shaped structure can be used for forming the antenna component 1. In particular, as shown in FIG. 1, the interval portions 2 can be set on the two long sides of the thermo vent, respectively, and the interval portions 2 are insulated, such that the current can not pass through these interval portions. For example, according to an embodiment of the present invention, the interval portions 2 are set on one of the two long sides of the thermo vent along the position corresponding to two adjacent metallic bars and a gap enclosed by the adjacent metallic bars, and the set interval portions are alternated on the two long sides. With the interval portions 2 set in the above manner, a metallic wire (bypass path) in a square wave shape is formed on the metallic thermo vent with the barrier shaped structure. According to the embodiment of the present invention, the metallic wire with the square wave shape as shown in FIG. 1 is used as the antenna component 1 (i.e., gap antenna) according to the embodiment of the present invention. Here, the purpose of using the gap antenna with the square wave shape (bypass shape) as the antenna component 1 is to extend the antenna component 1 as long as possible, such that the antenna component 1 is capable of supporting bands (e.g., 1800 MHz and 1900 MHz for 3G, and 2.4 GHz for WIFI) as much as possible, in particular, the bands in low-frequency. Here, according to the principal of the antenna, since the transmission/reception of the RF signal of a particular frequency can be supported in case that the antenna length is more than ¼ of the wavelength of the RF signal of the frequency, and the wavelength can be obtained by dividing the speed of light by the frequency, the interval of the metallic bars and the interval of the interval portions 2 can be designed appropriately to make the antenna component 1 to support the RF signals with various frequencies. For example, in case of the 3G signal with 1800 MHz, the wavelength of the RF signal thereof is $3*10^8/1800M=0.167$ m, and the ¼ wavelength thereof is 4.16 cm. Therefore, as long as the interval of the metallic bars and the interval of the interval portions 2 are designed appropriately to make the length of the antenna component 1 greater than 4.16 cm, the antenna component 1 can support the transmission and reception of the RF signal with 1800 MHz. Here, since the wavelengths of the 3G 1900 MHz signal and the WIFI 2.4 GHz signal are both less than that of the 3G 1800 MHz signal, obviously the antenna component 1 can support the signal with the above frequencies. Further, the present invention is not limited thereto, the interval of the metallic bars and the interval of the interval portions 2 can be designed appropriately to make the antenna component 1 to support various low-frequency signals (e.g., 2G 800 MHz RF signal or any other wireless signals).

Further, the present invention is not limited thereto, if the metallic thermo vent is large enough (e.g., the length of the long side is greater than 4 cm), the two long sides of the thermo vent, instead of the structure of the gap antenna, can be directly used as the antenna component.

Further, according to another embodiment of the present invention, the thermo vent can be made of non-metallic material. In this case, if the thermo vent has a barrier shaped structure, the barrier shaped structure of the thermo vent can be covered (e.g., electroplated) with a metallic layer in the same shape as the antenna component 1 as shown in FIG. 1, so as to form a gap antenna with a predetermined interval as the antenna component. Further, the thermo vent is a unimpeded hole, and does not have a barrier shaped structure, thus, metallic bars with a predetermined interval can be set between the two long sides of the thermo vent, and a metallic layer can be set on the two long sides of the thermo vent to form a gap antenna in the same shape as the antenna component 1 as shown in FIG. 1 as the antenna component. Here, since the structure of the air inlet and that of the air vent are similar, the relevant description of implementing an antenna component at the air inlet is omitted.

With the above configuration, the antenna component is implemented by the air inlet or the thermo vent. In this case, since an adequate headroom area is not needed to be set in the terminal device, the position of the respective hardware can be arranged flexibly without considering the influence of the antenna unit, thus the design of the terminal device can be simpler. Further, since an adequate headroom area is not needed to be set in the terminal device, the terminal device can be more compact. Further, since the antenna component implemented by the air inlet or the thermo vent has an adequate headroom area, the quality of transmitting/receiving the RF signal can be ensured.

The antenna component according to the embodiment of the present invention is described above. Here, since the antenna component implemented by the air inlet or the thermo vent will radiate about a half of the RF signals to the internal of the terminal device, the transmission power of a part of the RF signals may be wasted.

Figure 2:
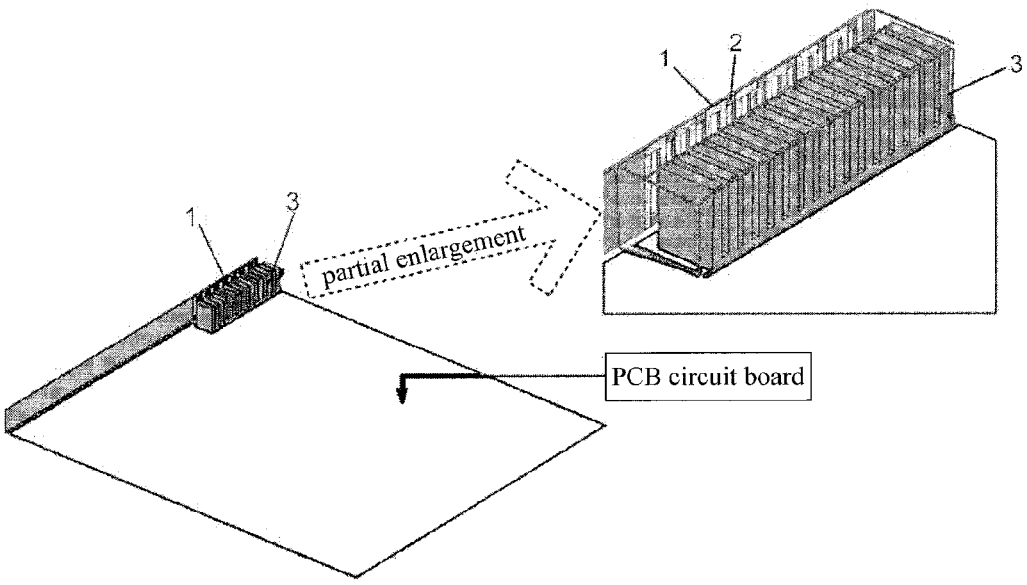
FIG. 2 is a schematic diagram illustrating the structure of the signal reflecting unit of an embodiment of the present invention.

For this case, a signal reflecting unit according to one embodiment of the present invention will be described with reference to FIG. 2. FIG. 2 is a schematic diagram illustrating the structure of the signal reflecting unit according to one embodiment of the present invention.

As shown in FIG. 2, a RF signal reflecting unit 3 is set in the first house (the host part) accommodating the processing unit, the main board and the wireless communication unit. The RF signal reflecting unit 3 can be implemented by a metallic material, and is opposite the antenna component 1 and has a predetermined interval (in order to avoid the contact with the antenna component 1 and form a new antenna component). Here, the RF signal reflecting unit 3 may be used for reflecting the signal transmitted by the antenna unit.

According to one embodiment of the present invention, wherein, the RF signal reflecting unit 3 can be composed of a heat sink. In order to increase the efficiency of heat release, the heat sink with a certain height is usually set near and opposite the thermo vent opposite, and there is a predetermined interval (e.g., 1 cm) between the heat sink and the thermo vent. Since the heat sink is implemented by metallic material and is opposite the thermo vent, and the metallic material will reflect the RF signal reflected towards the heat sink. In this case, the heat sink implemented by the metallic material can reflect a part of the RF signals radiated to the heat sink back to the antenna component 1, and radiate it to the external of the terminal device through the gaps on the antenna component 1, thus the intensity (power) of the RF signals transmitted by the antenna component 1 can be further increased.

Further, in case that the terminal device does not have the heat sink, other hardware can be used as the signal reflecting unit 3.

For example, according to one embodiment of the present invention, the RF signal reflecting unit 3 can also be a part of a metallic surface of the hard disc. In particular, the position of the hard disc can be set so that the hard disc is near the thermo vent used as the antenna component 11. In this case, since the house of the hard disc is made of metal, a part of the metallic house thereof, i.e., the metallic surface opposite the thermo vent (the surface in the direction of thickness) can reflect the RF signal radiated to the part of the metallic surface. In this case, the house of the hard disc made of metallic material can reflect a part of the RF signals radiated to the heat sink back to the antenna component 1, and radiate it to the external of the terminal device through the gaps on the antenna component 1, thus the intensity (power) of the RF signals transmitted by the antenna component 1 can be further increased.

Further, according to another embodiment of the present invention, a metallic cavity can be set inside the first house and opposite the thermo vent used as the antenna component 1 and act as the RF signal reflecting unit. In particular, the metallic cavity can be made of metallic material, and it is opposite the thermo vent and has a predetermined interval. The metallic cavity is hollow, and has an opening part on the surface opposite the thermo vent, that is, the opening part is opposite the antenna unit. Further, the rest surface of the metallic cavity is closed. In this case, when the thermo vent used as the antenna component radiates a part of the RF signals to the internal of the terminal device, this part of the RF signals enters the hollow metallic cavity through the opening part, and makes a diffuse reflection in the metallic cavity. At last, the RF signals diffuse-reflected are reflected back to the antenna component 1 through the opening part, and radiated to the external of the terminal device through the gaps on the antenna component 1. Here, since the metallic cavity can reflect back most of the RF signals radiated to the internal of the terminal device, the configuration of a metallic cavity can increase the intensity (power) of the RF signals transmitted by the antenna component 1 to a large extent.

With the above configuration, by setting the RF signal reflecting unit opposite the antenna component, a part of the RF signals can be radiated by the antenna component to the internal of the terminal device can be reflected back to the antenna component, and radiated to the external of the terminal device through the gaps on the antenna component, thus the intensity (power) of the RF signals transmitted by the antenna component can be further increased.

Further, in the recent years, the various terminal devices such as mobile phones, music players, personal digital assistances (PDAs), game machines, portable computers are widely used. As the terminal device are required to be thinner and smaller, the design of the terminal device is highly challenged, and as the antenna of a portable terminal device becomes the gateway of communication, its design difficulty is significantly increased with the user's unceasing demands for the size, lightness, and thinness of the terminal device. At the same time, in order to improve the ability of the terminal device against risks, such as a fall and a collision, and to meet the need of the appearance design, such as metallic feeling, the frame of metal material is widely applied to the terminal device such as mobile phones.

However, the application of the metallic frame decreases the selectivity of the in-built antenna. For example, some types of antennas such as the conventional uni-pole, IFA become difficult to design and implement due to the metallic frame. Since the uni-pole, IFA antennas or the like needs to increase the area of the terminal device, which is against the demand of minimization. At the same time, the metallic frame makes the radiation environment of the antenna become more complicated, which is not advantageous for the radiation efficiency of the antenna. And the only selectable antenna is PIFAPIFA antenna. The PIFA antenna belongs to the resonant antenna, with a high quality factor Q. Its radiation is based on the radiation principal of the micro-strip patch antenna, and has the innate characteristic of narrow band-width per se, wherein the band-width of the antenna is in proportion to the height of the antenna. Therefore, the usage of the PIFA antenna needs the electronic apparatus to have a certain height, which is contradictory to the design demand of decreasing the thickness of the electronic apparatus.

Therefore, the embodiment of the present invention desires to further propose a gap-structured antenna unit for the terminal device and the corresponding terminal device to enable the terminal device to be designed thinner and lighter.

The embodiment of the present invention provides a gap-structured antenna unit applied to a terminal device. The antenna unit comprises: a first metallic component, a second metallic component with a first gap between the first metallic component and the second metallic component, a first grounding component, a second grounding component, a feed interface configured to feed the RF signal, a micro-strip feed line configured to be above the first gap and across the first gap with one end of the micro-strip feed line suspending in the air and the other end of the micro-strip feed line connecting to the feed interface, wherein, the first metallic component, the second metallic component, the first grounding component and the second grounding comment enclose a closed-loop gap structure and act as the gap-structured antenna unit.

The embodiment of the present invention further provides a terminal device including the gap-structured antenna unit. The antenna unit comprises: a first metallic component, a second metallic component with a first gap between the first metallic component and the second metallic component, a first grounding component, a second grounding component, a feed interface configured to feed the RF signal, a micro-strip feed line configured to be above the first gap and across the first gap with one end of the micro-strip feed line suspending in the air and the other end of the micro-strip feed line connecting to the feed interface, wherein, the first metallic component, the second metallic component, the first grounding component and the second grounding comment enclose a closed-loop gap structure and act as the gap-structured antenna unit.

Compared with the conventional in-built antenna, the gap-structured antenna unit of the embodiment of the present invention not only allows the existence of a metallic frame, but also decreases the thickness of the metallic frame, it makes possible to provide an ultra-thin mobile phone with a metallic frame. And, since the area occupied by the gap-structured antenna unit mainly depends on the width of the gap, the area occupied by the gap-structure is significantly less than the area occupied by the conventional in-built antenna.

Here, those skilled in the art can understand that the above gap-structured antenna unit can be applied to the above mentioned antenna unit formed by the air vent on the frame of the terminal device, and can be used separately. Hereafter, the gap-structured antenna unit will be described by taking the separate usage of the gap-structured antenna unit as an example.

Figure 3:
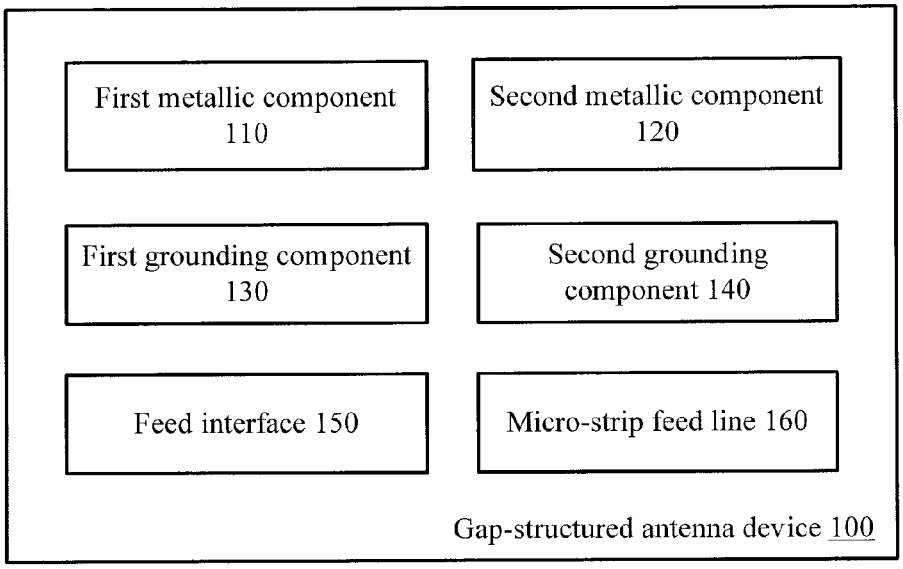
FIG. 3 is a block graph illustrating the schematic structure of a gap structure antenna device of an embodiment of the present invention.

FIG. 3 shows the schematic block view of the gap-structured antenna unit 100 according to one embodiment of the present invention. The gap-structured antenna unit 100 can be applied to a terminal device. In the embodiments of the present invention hereafter, the specific form of the terminal device comprises but is not limited to a mobile phone, a personal digital assistance, a panel computer, a game machine and a music player, etc. Hereafter, the gap-structured antenna unit according to the embodiment of the present invention will be described with reference to FIG. 3.

As shown in FIG. 3, the gap-structured antenna unit 100 can be applied to the terminal device. The gap-structured antenna unit 100 may comprise a first metallic component 110, a second metallic component 120, a first grounding component 130, a second grounding component 140, a feed interface 150 and a micro-strip feed line 160.

Specifically, there is a first gap between the first metallic component 110 and the second metallic component 120. According to one example of the present invention, the material of the first metallic component and the second metallic component may be zinc alloy or stainless steel. The first metallic component 110, the second metallic component 120, the first grounding component 130 and the second grounding component 140 enclose a closed-loop gap structure as the gap-structured antenna unit. For example, the first grounding component 130 and the second grounding component 140 may be set at both ends of the first gap to enclose the closed-loop gap structure. According to one example of the present invention, a filling material can be added in the closed-loop gap structure by injection molding process, to connect the first metallic component and the second metallic component. The filling material is insulated material such as polyphenylene sulfide (pps).

Further, according to another example of the present invention, a headroom area with predetermined volume may be set around the closed-loop gap structure. Specifically, no metallic component is set in the headroom area.

The distance between the first grounding component and the second grounding component can be determined by the low-frequency designed resonant frequency of the gap-structured antenna unit. As above mentioned, the first grounding component 130 and the second grounding component 140 may be set on the two ends of the first gap, and the length of the first gap (i.e., the length between the first grounding component 130 and the second grounding component 140) can be determined by the low-frequency resonant frequency needed by the specific design demand. More specifically, the length of the first gap may correspond to the half wave length of the gap-structured antenna device. That is, the gap-structured antenna device may resonate at the half of the wave length, so that the antenna performance thereof is better than that of the conventional in-built antenna with a quarter wave-length. Further, the width of the first gap can be determined by the designed band-width of the gap-structured antenna unit.

The feed interface 150 may transmit the RF signal received/transmitted therethrough by the gap-structured antenna unit 100 via the micro-strip feed line 160 to the front-end RF circuit of the terminal device. The micro-strip feed line 160 may be set above the first gap and across the first gap. Specifically, the micro-strip feed line 160 is across the first gap, and one end of the micro-strip feed line 160 suspends in the art, and the other end connects the feed interface. That is, the gap-structured antenna unit does not contact the micro-strip feed line, and the front-end RF circuit in the terminal device couples the feed to the gap-structured antenna device via the micro-strip feed line.

According to one example of the present invention, the material of the micro-strip feed line may be Cu. Preferably, the distance between the first gap and the micro-strip feed line 160 may be equal to or greater than 1 mm. Further, a clapboard made of for example Polycarbonate Acrylonitrile Butadiene—styrene copolymer and mixtures (PC-ABS) may be set between the micro-strip feed line and the first gap.

According to one example of the present invention, the distance between the projection location of the micro-strip feed line 160 in the first gap and the first grounding component 130 can be determined by the high-frequency designed resonant frequency of the gap-structured antenna unit.

Compared with the conventional in-built antenna, the gap-structured antenna unit according to the present embodiment not only allows the existence of the metallic frame, but also can decrease the thickness of the metallic frame, thereby makes providing an ultra-thin terminal device with a metallic frame possible. And, since the area occupied by the gap-structured antenna unit mainly depends on the width of the gap, the area occupied by the gap structure is significantly less than the area occupied by the conventional in-built antenna.

Figure 4:
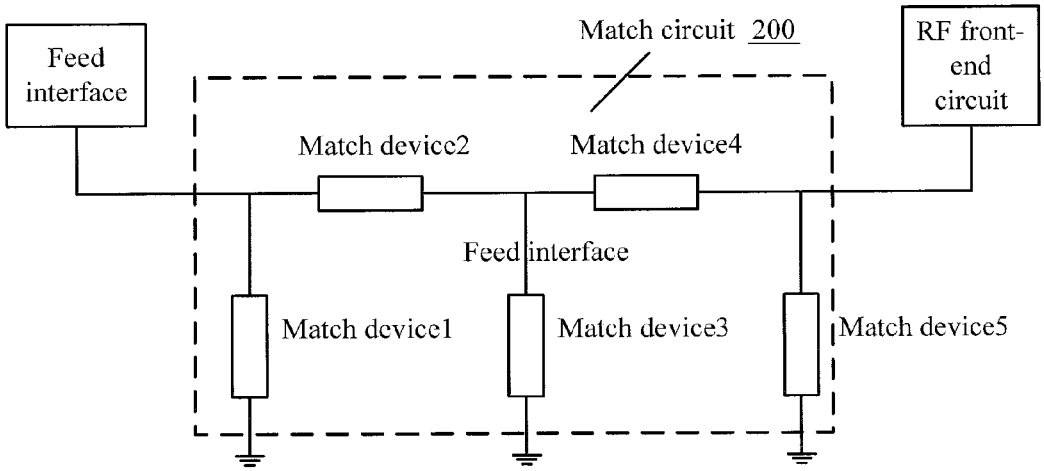
FIG. 4 is a circuit graph illustrating a match circuit of an embodiment of the present invention.

Further, according to another example of the present invention, the gap-structured antenna unit 100 may further comprise a match circuit to adjust the resonant frequency of the metallic frame antenna. Specifically as above mentioned, since one end of the micro-strip feed line 160 is open, a strong capacitive effect will be introduced. FIG. 4 is a circuit graph showing the match circuit according to one embodiment of the present invention. As shown in FIG. 4, the match circuit 200 comprises match devices 201-205. The match device 201 in the match circuit 200 is generally an inductor connected in series or in parallel to compensate the capacitance introduced by the open micro-strip line to ensure the optimal performance of the antenna unit. As shown in FIG. 4, the match circuit may be connected between the feed interface and the RF front-end circuit of the terminal device.

Further, according to another example of the present invention, the gap-structured antenna unit 100 may further comprise a high-frequency branch antenna to extend the high-frequency band-width of the antenna device. For example, the high-frequency branch antenna may be a second gap set in the second metallic component communicated to the first gap. Alternatively, the high-frequency branch antenna may be a second gap set in the first metallic component communicated to the first gap. In case of the gap-structured antenna unit 100 comprising the high-frequency branch antenna, the micro-strip feed line in the antenna unit is still set over the second gap and across the second gap. That is, the micro-strip feed line is across the first gap and the second gap, respectively, and the high-frequency branch antenna does not contact the micro-strip feed line, the front-end RF circuit in the terminal device couples the feed to the high-frequency branch antenna via the micro-strip feed line.

Figure 5:
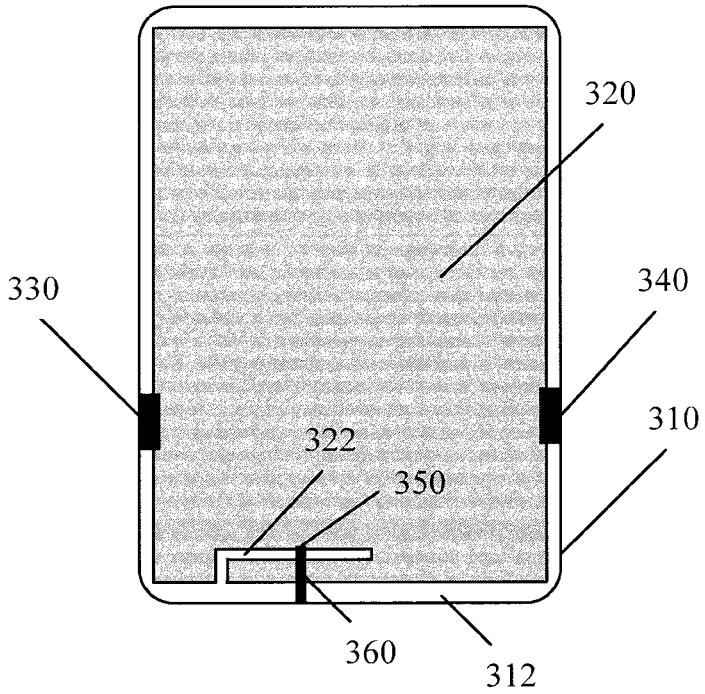
FIG. 5 is a cross section view illustrating the gap structure antenna device of an embodiment of the present invention.

FIG. 5 is a cross section view of the gap-structured antenna unit according to one embodiment of the present invention. The gap-structured antenna unit according to one embodiment of the present invention will be described with reference to FIG. 5 hereafter. In the example shown in FIG. 5, it will be described by taking the first metallic component as a metallic frame of the terminal device and the second metallic component as an enhanced metallic panel set in the terminal device.

As shown in FIG. 5, the gap-structured antenna device 300 comprises a metallic frame 310 and an enhanced metallic panel 320 set inside the terminal device. There are gaps between each side of the rectangle metallic frame 310 and the enhanced metallic panel 320. Insulated material such as polyphenylene sulfide may be added between the rectangle metallic frame 310 and the enhanced metallic panel 320 by the injection molding process to connect the rectangle metallic frame 310 and the enhanced metallic panel 320.

Further, the gap-structured antenna unit 300 further comprises a first grounding component 330 and a second grounding component 340. The rectangle metallic frame 310, the enhanced metallic panel 320, the first grounding component 330 and the second grounding component 340 enclose a closed-loop gap structure. As shown in FIG. 5, the enclosed closed-loop gap structure comprises a first gap 312 between the rectangle metallic frame 310 and the enhanced metallic panel 320. The distance between the first grounding component 330 and the second grounding component 340 (i.e., the length of the first gap 312) can be determined by the low-frequency designed resonant frequency of the gap-structured antenna unit. For example, in the example shown in FIG. 5, the first gap 312 can be a "U" shaped structure.

Further, the gap-structured antenna unit 300 further comprises a second gap 322 formed on the enhanced metallic panel 320 to act as a high-frequency gap branch antenna and extend the high-frequency band-width of the antenna device. The second gap is connected with the first gap 312.

Further, the gap-structured antenna unit 300 further comprises a feed interface 350 and a micro-strip feed line 360. The micro-strip feed line 360 is set over the first gap 312 and the second gap 322, and is across the first gap 312 and the second gap 322. One end of the micro-strip feed line 360 near the rectangle metallic frame 310 suspends in the air, and the other end of the micro-strip feed line connects the feed interface 350. That is, the gap-structured antenna unit does not contact the micro-strip feed line, and the front-end RF circuit in the terminal device couples the feed to the gap-structured antenna device via the micro-strip feed line. Preferably, the distance between the first and second gaps 312, 322 and the micro-strip feed line 360 can be equal to or greater than 1 mm. Further, a clapboard made of for example Polycarbonate Acrylonitrile Butadiene—styrene copolymer and mixtures (PC-ABS) may be set between the micro-strip feed line and the first gap.

The distance between the projection location of the micro-strip feed line 360 in the first gap and the first grounding component 330 can be determined by the high-frequency designed resonant frequency of the gap-structured antenna unit 300.

Further, a headroom area with predetermined volume can be set around the gap-structured antenna unit 300. Specifically, no metallic component is set in the headroom area to ensure excellent radiation environment and decrease the electro-magnetic interference.

In the present embodiment, it is described by taking the rectangle metallic frame as an example, but the embodiment of the present invention is not limited thereto. Further, a metallic frame of an entire structure without any breakpoint can be used as the frame of the terminal device, so as to decrease the influence on the antenna performance when the user holds the breakpoint in compared with the antenna of the terminal device employing the metallic frame with breakpoints.

Figure 6:
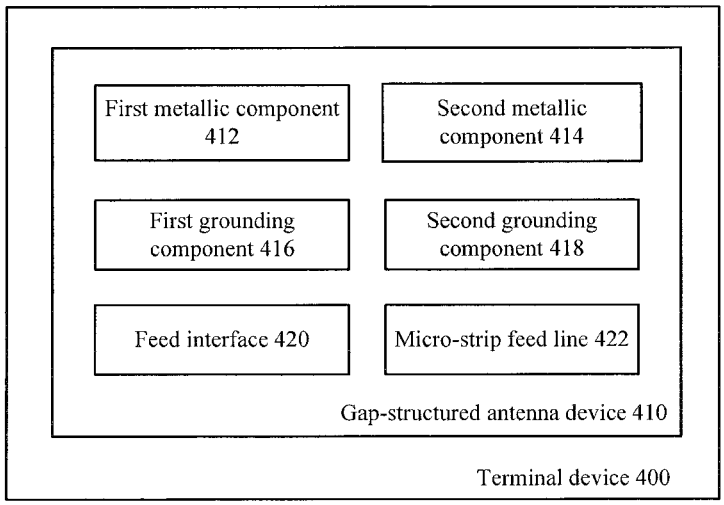
FIG. 6 is a schematic block graph illustrating the terminal device of an embodiment of the present invention.

As above mentioned, the antenna unit in the above embodiments can be applied to the terminal device. FIG. 6 shows a schematic block view of a terminal device 400 according to one embodiment of the present invention. Hereafter, the terminal device 400 according to one embodiment of the present invention will be described with reference to FIG. 6.

As shown in FIG. 6, the terminal device 400 comprises a gap-structured antenna unit 410. The gap-structured antenna unit 410 comprises a first metallic component 412, a second metallic component 414, a first grounding component 416, a second grounding component 418, a feed interface 420 and a micro-strip feed line 422. The components in the antenna unit 410 are similar to the respective ones in the gap-structured antenna unit 100 shown in FIG. 3. Therefore, it would not be described in detail for simplicity.

For example, there is a first gap between the first metallic component 412 and the second metallic component 414. The first metallic component 412, the second metallic component 414, the first grounding component 416 and the second grounding component 418 enclose a closed-loop gap structure as the gap-structured antenna unit. The first grounding component 416 and the second grounding component 418 may be set at the two ends of the first gap to enclose the closed-loop gap structure. According to one example of the present invention, filling material can be added in the closed-loop gap structure by the injection molding process to connect the first metallic component and the second metallic component. The filling material is insulated material, for example, polyphenylene sulfide (pps).

The feed interface 420 may transmit the RF signal received/transmitted therethrough by the gap-structured antenna unit 410 via the micro-strip feed line 422 to the front-end RF circuit (not shown) in the terminal device 400. The micro-strip feed line 422 may be set over the first gap and across the first gap. Specifically, the micro-strip feed line 422 is across the first gap, with one end of the micro-strip feed line 422 suspending in the air, and the other end connected to the feed interface 420. That is, the gap-structured antenna unit does not contact the micro-strip feed line, the front-end RF circuit in the terminal device 400 couples the feed to the gap-structured antenna unit 410 via the micro-strip feed line 422.

Though it is described by taking the terminal device comprising one gap-structured antenna unit as an example in the present embodiment, the present invention is not limited thereto. For example, the terminal device comprises a plurality of gap-structured antenna units. Specifically, in the terminal device comprising the metallic frame and the enhanced metallic panel set in the terminal device, a plurality of gap-structured antenna units can be set by using the gaps between the metallic frame and the enhanced metallic panel set in the terminal device.

Figure 7:
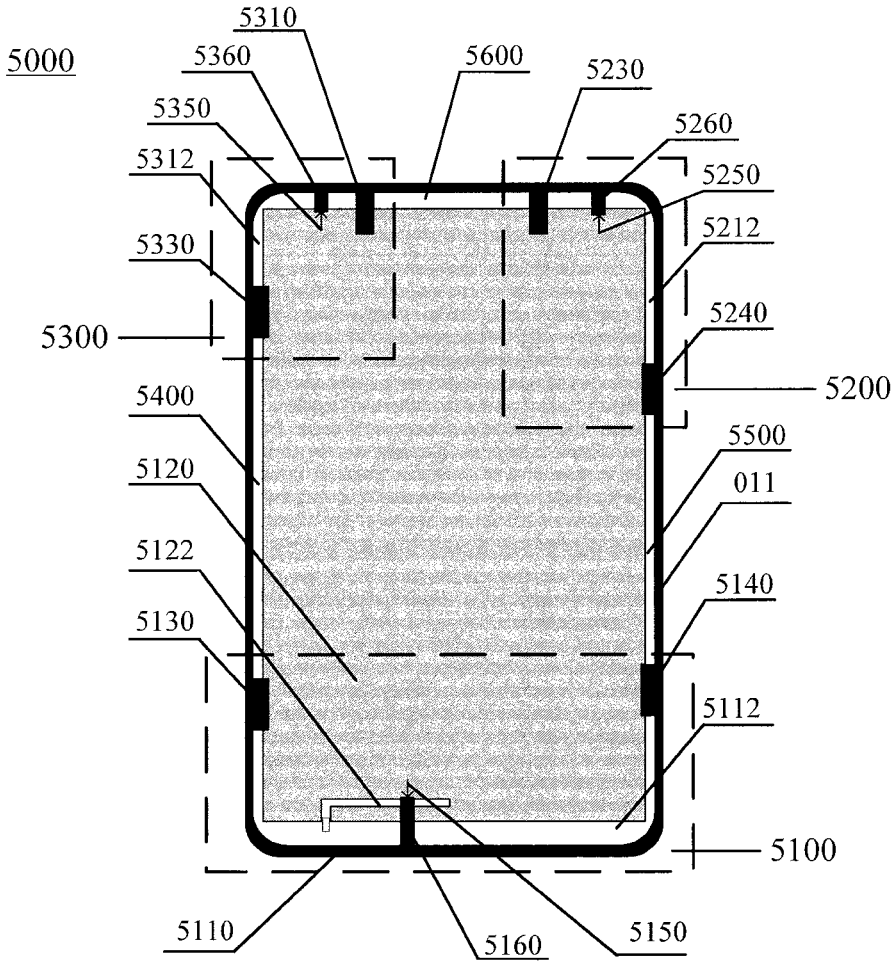
FIG. 7 is cross section view illustrating the terminal device of an embodiment of the present invention.

FIG. 7 shows a cross section view of the terminal device according to one embodiment of the present invention. In the example shown in FIG. 7, it is described by taking a cellular mobile phone as an example. As shown in FIG. 7, the cellular mobile phone 5000 comprises a first gap-structured antenna unit 5100, a second gap-structured antenna unit 5200 and a third gap-structured antenna unit 5300.

The first gap-structured antenna unit 5100 may be a main antenna of the cellular mobile phone 5000. The low-frequency working band of the first gap-structured antenna unit 5100 may be 820-960 MHz, and the high-frequency working band of the first gap-structured antenna unit 5100 may be 1710-2170 MHz to cover five bands of GSM850, GSM900, DCS1800, PCS1900 and UMTS at the same time.

The first gap-structured antenna unit 5100 may comprise a metallic frame 5110 and an enhanced metallic panel 5120 set in the terminal device. There are gaps between each side of the rectangle metallic frame 5110 and the enhanced metallic panel 5120. Insulated material such as polyphenylene sulfide can be added between the rectangle metallic frame 5110 and the enhanced metallic panel 5120 by the injection molding process to connect the rectangle metallic frame 5110 and the enhanced metallic panel 5120.

Further, the first gap-structured antenna unit 5100 further comprises the first grounding component 5130 and the second grounding component 5140. The rectangle metallic frame 5110, the enhanced metallic panel 5120, the first grounding component 5130 and the second grounding component 5140 enclose a closed-loop gap structure. As shown in FIG. 7, the enclosed closed-loop gap structure comprises the first gap 5112 between the rectangle metallic frame 5110 and the enhanced metallic panel 5120. The distance between the first grounding component 5130 and the second grounding component 5140 (i.e., the length of the first gap 5112) can be determined according to the low-frequency designed resonant frequency of the first gap-structured antenna unit 5100.

Further, the first gap-structured antenna unit 5100 further comprises a second gap 5122 formed on the enhanced metallic panel 5120 as a high-frequency gap branch antenna to extend the high-frequency band-width of the antenna device. The second gap 5122 is communicated to the first gap 5112.

Further, the first gap-structured antenna unit 5100 further comprises a first feed interface 5150 and a first micro-strip feed line 5160. The first micro-strip feed line 5160 is set over the first gap 5112 and the second gap 5122, and across the first gap 5112 and the second gap 5122. The end of the first micro-strip feed line 5160 near the rectangle metallic frame 5110 is suspending in the air, with the other end of the first micro-strip feed line 5160 connected to the first feed interface 5150. That is, the first gap-structured antenna unit 5100 does not contact the first micro-strip feed line 5160, and the front-end RF circuit in the terminal device 5000 couples the feed to the first gap-structured antenna unit 5100 via the first micro-strip feed line 5160. Preferably, the distance between the first and second gaps 5112, 5122 and the first micro-strip feed line 5160 is equal to or greater than 1 mm. Further, a clapboard made of, for example, Polycarbonate Acrylonitrile Butadiene—styrene copolymer and mixtures (PC-ABS) my be set between the first micro-strip feed line and the first gap and between the first micro-strip feed line and the second gap.

The distance between the projection location of the micro-strip feed line 5160 in the first gap and the first grounding component 5130 can be determined by the high-frequency design resonant frequency of the gap-structured antenna unit 5100.

The second gap-structured antenna unit 5200 may be a GPS antenna of the cellular mobile phone 5000. The working band of the second gap-structured antenna unit 5200 may be 1575 MHz.

The second gap-structured antenna unit 5200 may comprise a metallic frame 5110 and an enhanced metallic panel 5120 set in the terminal device. As above mentioned, there are gaps between each side of the rectangle metallic frame 5110 and the enhanced metallic panel 5120. Insulated material such as polyphenylene sulfide can be added between the rectangle metallic frame 5110 and the enhanced metallic panel 5120 by the injection molding process to connect the rectangle metallic frame 5110 and the enhanced metallic panel 5120.

Further, the second gap-structured antenna unit 5200 further comprises a third grounding component 5230 and a fourth grounding component 5240. The rectangle metallic frame 5110, the enhanced metallic panel 5120, the third grounding component 5230 and the fourth grounding component 5240 enclose a closed-loop gap structure. As shown in FIG. 7, the enclosed closed-loop gap structure comprises a third gap 5212 between the rectangle metallic frame 5110 and the enhanced metallic panel 5120. The distance between the third grounding component 5230 and the fourth grounding component 5240 (i.e., the length of the third gap 5212) can be determined by the resonant frequency of the second gap-structured antenna unit 5200.

Further, the second gap-structured antenna unit 5200 further comprises a second feed interface 5250 and a second micro-strip feed line 5260. The second micro-strip feed line 5260 is set over the third gap 5212, and across the third gap 5212. One end of the second micro-strip feed line 5260 near the rectangle metallic frame 5110 is suspending in the air, and the other end of the second micro-strip feed line 5260 is connected to the second feed interface 5250. That is, the gap-structured antenna unit does not contact the micro-strip feed line. The front-end RF circuit in the terminal device couples the feed to the gap-structured antenna unit via the micro-strip feed line. Preferably, the distance between the third gap 5212 and the second micro-strip feed line 5260 is equal to or greater than 1 mm. Further, a clapboard made of, for example, Polycarbonate Acrylonitrile Butadiene—styrene copolymer and mixtures (PC-ABS) may be set between the second micro-strip feed line and the third gap.

The distance between the projection location of the second micro-strip feed line 5260 in the third gap and the third grounding component 5230 can be determined by the designed resonant frequency of the second gap-structured antenna unit 5200.

The third gap-structured antenna unit 5300 may be a WIFI antenna of the cellular mobile phone 5000. The working band of the third gap-structured antenna unit 5300 may be 2400 MHz-2480 MHz.

The third gap-structured antenna unit 5300 may comprise a metallic frame 5110 and an enhanced metallic panel 5120 set in the terminal device. As above mentioned, there are gaps between each side of the rectangle metallic frame 5110 and the enhanced metallic panel 5120. Insulated material such as polyphenylene sulfide can be added between the rectangle metallic frame 5110 and the enhanced metallic panel 5120 by the injection molding process to connect the metallic frame 5110 and the enhanced metallic panel 5120.

Further, the third gap-structured antenna unit 5300 further comprises a fifth grounding component 5330 and a sixth grounding component 5340. The rectangle metallic frame 5110, the enhanced metallic panel 5120, the fifth grounding component 5330 and the sixth grounding component 5340 enclose a closed-loop gap structure. As shown in FIG. 5, the enclosed closed-loop gap structure comprises a fourth gap 5312 between the rectangle metallic frame 5110 and the enhanced metallic panel 5120. The distance between the fifth grounding component 5330 and the sixth grounding component 5340 (i.e., the length of the fourth gap 5312) can be determined by the resonant frequency of the third gap-structured antenna unit 5300.

Further, the third gap-structured antenna unit 5300 further comprises a third feed interface 5350 and a third micro-strip feed line 5360. The third micro-strip feed line 5360 is set over the fourth gap 5312, and across the fourth gap 5312. The one end of the third micro-strip feed line 5360 near the rectangle metallic frame 5110 is suspending in the air, and the other end of the third micro-strip feed line 5360 is connected to the third feed interface 5350. That is, the gap-structured antenna unit does not contact the micro-strip feed line, and the front-end RF circuit in the terminal device couples the feed to the gap-structured antenna unit via the micro-strip feed line. Preferably, the distance between the fourth gap 5312 and the third micro-strip feed line 5360 may be equal to or greater than 1 mm. Further, a clapboard made of for example Polycarbonate Acrylonitrile Butadiene—styrene copolymer and mixtures (PC-ABS) may be set between the third micro-strip feed line and the fourth gap.

The distance between the projection location of the third micro-strip feed line 5360 in the fourth gap and the fifth grounding component 5330 can be determined by the design resonant frequency of the third gap-structured antenna unit 5300.

Compared with the terminal device using the conventional in-built antenna, the terminal device according to the present embodiment not only allows the existence of the metallic frame, but also can decrease the thickness of the metallic frame, thereby makes providing an ultra-thin terminal device with metallic frame possible. And, since the area occupied by the gap-structured antenna unit mainly depends on the width of the gap, the area occupied by the gap-structure is significantly less than the area occupied by the conventional in-built antenna, so as to further reduce the size of the terminal device.

Further, the gaps 5400, 5500 and 5600 between the first gap-structured antenna unit 5100, the second gap-structured antenna unit 5200 and the third gap-structured antenna unit 5300 can be grounded. Alternatively, the gaps 5400, 5500 and 5600 can be designed for the sub antenna such as cascaded antenna.

Further, as shown in FIG. 7, in the terminal device according to the present embodiment, the gap-structured antenna unit can be set at the corner of the metallic frame, to further ensure excellent radiation environment and reduce the electro-magnetic interference.

As above mentioned, the gap-structured antenna unit shown in FIG. 3 to FIG. 7 can either be implemented by the air vent, as a main body, set on the house of the terminal device, or be set on other locations of the terminal device as a separate antenna unit, for example, at the corner of the metallic frame. When it is implemented by the air vent, as a main body, set on the house of the terminal device, as above mentioned, the above gap-structured antenna unit can be implemented by the metallic bars with a predetermined interval set between the two long sides of the thermo vent, for example. Here those skilled in the art may understand that the embodiments of the present invention are not intended to set restrictions. The above describes each embodiment of the present invention. It should be understood by those skilled in the art that various modifications, combinations, sub-combinations may occur to these embodiments of the present invention as long as they do not deviate from the principle and spirit of the present invention. Further, the amendments made are within the scope of the present invention.

What is claimed is:

1. A terminal device, comprising:

a first house configured to at least accommodate a processing unit, and a wireless communication unit;

the wireless communication unit configured to cause the terminal device to perform wireless communication with an external apparatus and exchange data, the wireless communication unit further comprising:

an antenna unit configured to receive and transmit a RF signal;

a RF circuit connected with the antenna unit and configured to transmit the RF signal to or receive the RF signal from the antenna unit, wherein, an air vent is set on the first house, the antenna unit is formed by the air vent, and the antenna unit is a gap-structured antenna unit that comprises:

a first metallic component, a second metallic component with a first gap between the first metallic component and the second metallic component, a first grounding component, a second grounding component, a feed interface configured to feed the RF signal, a micro-strip feed line configured to be above the first gap and across the first gap with one end of the micro-strip feed line suspending in the air and the other end of the micro-strip feed line connected to the feed interface, wherein, the first metallic component, the second metallic component, the first grounding component and the second grounding comment enclose a closed-loop gap structure as the gap-structured antenna unit.

2. The terminal device according to claim 1, wherein, a headroom area with a predetermined volume is set around the closed-loop gap structure, wherein, there is no metallic component in the headroom area.

3. The terminal device according to claim 1, wherein, the distance between the first grounding component and the second grounding component is determined according to the low-frequency designed resonant frequency of the gap-structured antenna unit, and the width of the first gap is determined by the designed band-width of the gap-structured antenna unit.

4. The terminal device according to claim 1, wherein, the distance between the projection location of the micro-strip feed line in the first gap and the first grounding component is determined according to the high-frequency designed resonant frequency of the gap-structured antenna unit.

5. The terminal device according to claim 1, wherein, the first metallic component is a metallic frame of the terminal device, the second metallic component is an enhanced metallic panel set in the terminal device, there are gaps between each side of the metallic frame and the enhanced metallic panel.

6. The terminal device according to claim 1, further comprises:

a high-frequency branch antenna to extend the high-frequency band-width of the antenna device.

7. The terminal device according to claim 6, wherein:

the high-frequency branch antenna is a second gap set in the second metallic component communicated with the first gap;

the micro-strip feed line is set over the second gap and across the second gap.

8. The terminal device according to claim 1, further comprises:

a match circuit connected to the feed interface to adjust the resonant frequency of the antenna device.

9. The terminal device according to claim 1, wherein:

a clapboard is set between the micro-strip feed line and the first gap.

10. The terminal device according to claim 1, wherein filling material is added in the closed-loop gap structure by the injection molding process to connect the first metallic component and the second metallic component.

11. A gap-structured antenna unit applied to a terminal device, the antenna unit comprises:

a first metallic component, a second metallic component with a first gap between the first metallic component and the second metallic component, a first grounding component, a second grounding component, a feed interface configured to feed the RF signal, a micro-strip feed line configured to be above the first gap and across the first gap with one end of the micro-strip feed line suspending in the air and the other end of the micro-strip feed line connected to the feed interface, wherein, the first metallic component, the second metallic component, the first grounding component and the second grounding comment enclose a closed-loop gap structure as the gap-structured antenna unit.

12. A terminal device comprises:

a first metallic component, a second metallic component with a first gap between the first metallic component and the second metallic component, and a first gap-structured antenna unit is formed by the first metallic component and the second metallic components, the first gap-structured antenna unit further comprises:

a first grounding component, a second grounding component, a first feed interface configured to feed the RF signal for the first gap-structured antenna unit, a first micro-strip feed line configured to be above the first gap and across the first gap with one end of the first micro-strip feed line suspending in the air and the other end of the first micro-strip feed line connected to the first feed interface, wherein, the first metallic component, the second metallic component, the first grounding component and the second grounding comment enclose a closed-loop gap structure as the first gap-structured antenna unit.

13. The terminal device according to claim 12, wherein, the first metallic component is a metallic frame of the terminal device, the second metallic component is an enhanced metallic panel set in the terminal device.

14. The terminal device according to claim 13, wherein, a third gap is set between the second metallic component and the first metallic component, the terminal device further comprises:

a second gap-structured antenna unit is formed by the first metallic component and the second metallic components, the second gap-structured antenna unit further comprises:

a third grounding component, a fourth grounding component, a second feed interface configured to feed the RF signal for the second gap-structured antenna unit, a second micro-strip feed line configured to be above the third gap and across the third gap with one end of the second micro-strip feed line suspending in the air and the other end of the second micro-strip feed line connected to the second feed interface, wherein, the first metallic component, the second metallic component, the third grounding component and the fourth grounding comment enclose a closed-loop gap structure as the second gap-structured antenna unit.

15. The terminal device according to claim 14, wherein, a fourth gap is set between the second metallic component and the first metallic component, the terminal device further comprises:

a third gap-structured antenna unit is formed by the first metallic component and the second metallic components, the third gap-structured antenna unit further comprises:

a fifth grounding component, a sixth grounding component, a third feed interface configured to feed the RF signal for the third gap-structured antenna unit, a third micro-strip feed line configured to be above the fourth gap and across the fourth gap with one end of the third micro-strip feed line suspending in the air and the other end of the third micro-strip feed line connected to the third feed interface, wherein, the first metallic component, the second metallic component, the fifth grounding component and the sixth grounding comment enclose a closed-loop gap structure as the third gap-structured antenna unit.

* * * * *